United States Patent [19]

Hölzel

[11] Patent Number: 5,040,312

[45] Date of Patent: Aug. 20, 1991

[54] DRYING APPARATUS

[76] Inventor: Helmuth Hölzel, Bernoder Weg 7, D-8250 Dorfen, Fed. Rep. of Germany

[21] Appl. No.: 487,046

[22] Filed: Mar. 2, 1990

[30] Foreign Application Priority Data

Mar. 3, 1989 [DE] Fed. Rep. of Germany ..... 3906849

[51] Int. Cl.[5] ..... F26B 13/30

[52] U.S. Cl. ..... 34/92; 34/151

[58] Field of Search ..... 34/92, 15, 16, 143, 34/145, 148, 151

[56] References Cited

U.S. PATENT DOCUMENTS 4,788,778 12/1988 Fernwood ..... 34/92

*Primary Examiner*—Henry A. Bennet

*Attorney, Agent, or Firm*—Fleit, Jacobson, Cohn, Price, Holman & Stern

[57] ABSTRACT

A drying apparatus for drying gels and biological substances has a base with a drying area, surrounded by a sealing surface, for receiving the substance to be dried and a cover, whose marginal area can be placed in vacuum-tight manner on the sealing surface and the drying space formed between the drying area and the cover can be evacuated. In order to achieve a good and reliable sealing of the drying space and to prevent the penetration of ambient air into the latter, the sealing surface in the cover bearing area and/or the marginal area of the cover resting on the sealing surface are constructed in rubber-elastic manner and at least one closed evacuatable groove is formed in the sealing surface. The cover rests on the sealing surface on either side of the groove.

12 Claims, 3 Drawing Sheets

DRYING APPARATUS

BACKGROUND OF THE INVENTION

The invention relates to a drying apparatus with a base, which has a drying area, surrounded by a sealing surface, for receiving a substance to be dried and in particular a gel, and with a cover, whose marginal area can be placed in vacuum-tight manner on the sealing surface and the drying space formed between the drying area and the cover can be evacuated.

Drying apparatuses of the aforementioned type are known and are e.g. used as desiccators in the chemical industry. Such desiccators are made from glass, the sealing surface of the apparatus base and the marginal area of the support being constructed as ground joints which are complimentary to one another and form a vacuum-tight connection, especially after being treated with grease. However, the sealing function in the vicinity of the sealing surface is very prone to contamination and consequently there is a risk of vacuum breakdowns, especially when there are low over-pressures in the drying space.

SUMMARY OF THE INVENTION

The object of the invention is to provide a drying apparatus allowing a good and reliable maintenance of an underpressure and whose function is not prone to contamination.

This object is achieved in the case of a drying apparatus of the aforementioned type in that the sealing surface in the bearing area of the cover and/or the cover in its marginal area placed on the sealing surface are constructed in rubber-elastic manner, that in the sealing surface is formed at least one closed groove, that the groove can be evacuated and that the cover rests on the sealing surface on either side of the groove.

Thus, in the vicinity of the sealing surface is formed a vacuum space independent of the drying space and which brings about a suction of the cover onto the sealing surface and therefore a better sealing contamination-intensitive seal of the drying space. A good seal is also ensured if the underpressure in the drying space and the resulting contact pressure of cover on the sealing surface is only small. A further advantage of this seal is that in the case of any leaks between the drying space and the atmosphere the vacuum space has a high vacuum, so that if leaks occur in the vicinity of the sealing surface, there is either only a lowering of the vacuum in the vacuum space, or an increase in the vacuum in the drying space in the case of a leak in the vacuum space with respect to the drying space. Thus, a very large amount of contamination is required both on the side facing the atmosphere and on the side of the sealing surface facing the drying space in order to cause ambient air to penetrate into said drying space. In the case of correct handling, the probability of this is very limited. A good and reliable sealing of the drying space is particularly important for drying electrophoretic gels and biological substances, because vacuum breakdowns can lead to a distruction, e.g. through the oxidizing on of these substances.

On either side of the groove, the vacuum space is sealed in vacuum-tight manner with respect to the external air and also the drying space by a rubber-elastic design of the cover and/or the sealing surface or by rubber-elastic seals on the cover or sealing surface. Advantageously the seals are arranged in parallel on either side of the groove, which has an additional sealing effect. It is also possible to bring about the vacuum sealing of the vacuum space by the rubber-elastic seals only.

The cover can be completely made from a rubber-elastic material, e.g. a strong plastic, latex or silicone sheet. Rubber-elastic seals on either side of the groove are not then necessary, because the sheet is drawn somewhat into the groove and consequently engages tightly on the upper edge of the groove.

For forming a higher drying space, the cover can be constructed as a stable hood, e.g. of plexiglass. It is then possible to provide thicker gel layers or drying racks for the drying of sheets within the drying space.

The underpressure in the drying space can be adjusted by means of a vacuum regulating device. For this purpose a connecting channel can be provided, e.g. between the groove and the drying area and in it is positioned the said regulating device. The underpressure produced by a vacuum is then completely applied to the groove, whilst the underpressure in the drying space is adjustable by the vacuum regulating device.

According to an advantageous further development of the invention, the drying area and the sealing surface are constituted by a one-piece metal plate, which can either be coated with chemically resistant high-grade metal or plastic. The metal plate forms a mechanically stable, vacuum-tight underside for the drying space and makes it possible to obtain a planar construction and therefore very good sealing sealing surfaces.

The cover is advantageously made from a transparent material so that the drying stage of the substance to be dried be observed.

Advantageous further developments of the invention form the subject matter of subclaims.

BRIEF DESCRIPTION OF THE DRAWINGS

The invention is described in greater detail hereinafter relative to the drawings, wherein show.

DESCRIPTION OF THE PREFERRED EMBODIMENT

Figure 1:
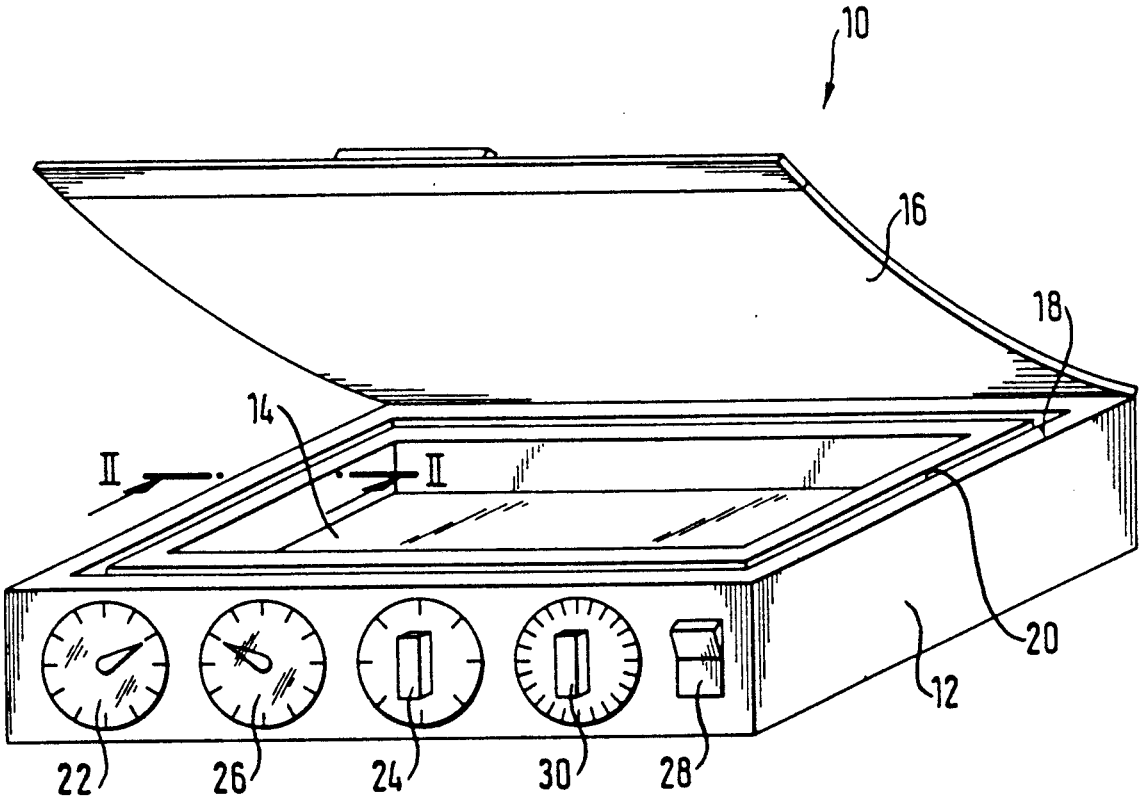
FIG. 1 a perspective view of a drying apparatus.

The drying apparatus 10 comprises a box-like apparatus base 12, whose top has a tray-shaped drying area 14, which can be covered by a rubber-elastic cover 16 pivotably articulated to the base 12. The cover 16 rests on a sealing surface 18 surrounding the drying area 14 of the apparatus base 10. A closed groove 20, connectable to an underpressure supply, runs along the sealing surface. In a manner to be described hereinafter, this leads to the cover 16 resting on the sealing surface 18 being drawn somewhat into the groove 20, which brings about a vacuum-tight seal between the sealing surface 18 and the cover 16.

An evacuatable drying space is formed between the drying area 14 of the apparatus base 12 and the cover 16 engaged on the sealing surface 18. For this purpose the drying apparatus 10 is provided with a vacuum regulating device. The vacuum indicator 22 for the drying space is located on the front panel of the apparatus base 12. The drying area and/or the cover are heatable, the temperature being set by means of the temperature selection switch 25 and can be read off a temperature indicator 26 on the front panel. The drying apparatus 10 is switched on by means of the on-off switch 28. A preselectable operating time can be set by means of clock 30.

Figure 2:
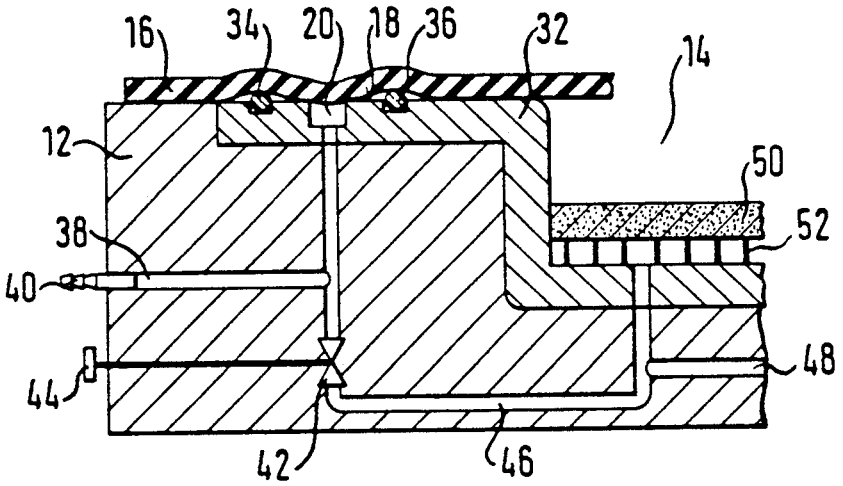
FIG. 2 section II of a wall area of the drying apparatus of FIG. 1. with the cover fitted.

FIG. 2 is a section through the wall area of the drying apparatus 10. The apparatus base 12 has a metal insert 32 forming the sealing surface 18 and the drying area 14 and whose surface is made substantially chemically resistant e.g. by a coating. On either side of the groove 20 is provided an elastic rubber seal 34, 36 in the form of a round cord or tube in a depression in the sealing surface 18.

Groove 20 is connected to an underpressure channel 38, which is provided with a connecting piece 40 for connection to an underpressure supply. By means of a pressure regulating valve 42, which can be manually operated by means of a control element 44, the underpressure channel 38 leads to a connecting channel 46, which connects the drying area 14 to the groove 20. From the connecting channel 46 branches a measuring channel 48 for the connection of a pressure gauge, whose indicator 22 is located in the front panel of the apparatus base 12.

On a grating 52 in the drying area 14 is located a porous plate 50, e.g. a fritted plate, so that even the underside of a substance resting on the porous plate 50 is dried.

A good sealing function of the drying apparatus 10 even in the case of limited underpressures in the drying space between the drying area 14 and the cover 16 resting on the sealing surface 18 is ensured in that, as a result of the underpressure in groove 20, the rubber-elastic cover 16 is drawn somewhat into the latter, so that the cover engages firmly on the upper edge of groove 20. In this way further vacuum space, independent of the underpressure in the drying space is formed between the latter and the ambient air and additionally shields the drying space against the penetration of ambient air. This effect is intensified by the two rubber-elastic seals 34, 36 on either side of the groove 20. A vacuum breakdown in the drying space is not even caused by small impurities on the sealing surface on either side of the groove, as a result of the high under-pressure in the underpressure space formed by the groove and the cover and due to the strong deformability of the rubber-elastic materials. In the vicinity of the sealing surface, the cover can also be constructed as a stable plate and then it is necessary to provide a rubber-elastic seal in the cover or in the sealing surface on either side of the groove.

Figure 3:
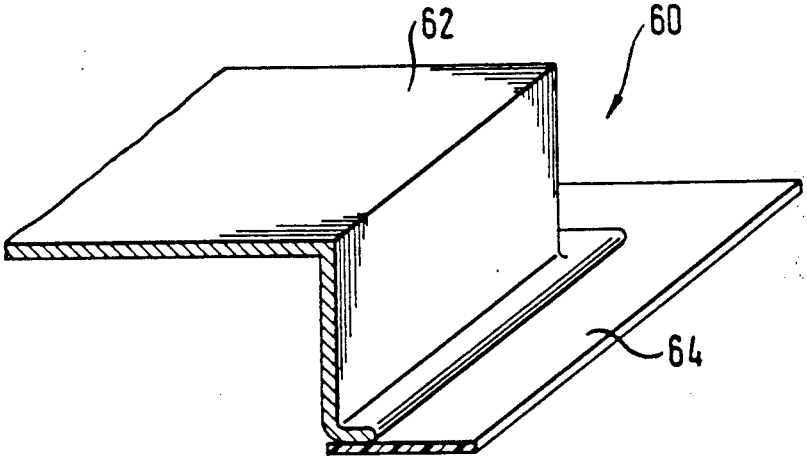
FIG. 3 a perspective material view of a stable cover for larger drying volumes.

FIG. 3 shows a cover 60, whose portion covering the drying space is constructed as a vacuum bell jar 62 with an internal useful height, which permits the use of commercial vessels in corresponding racks. The marginal area 64 of cover 60 covering the sealing surface 18 can be made from rubber-elastic or stable material.

An automatic vacuum regulating device can be used in place of the manual vacuum regulating device 42.

Figure 4:
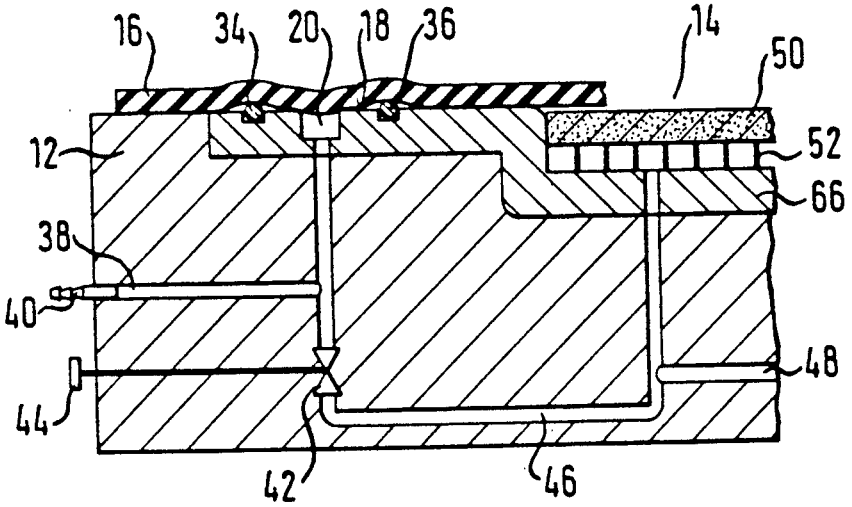
FIG. 4 a view according to FIG. 2 with a flat drying area.

FIG. 4 shows a detail from FIG. 2, in which identical parts are given the same reference numerals. The metal insert 66 forming the drying area 14 is constructed in shallow tray-like manner, so that the surface of the porous plate 50 substantially terminates with the sealing surface 18. This is particularly important when using rubber-elastic cover 16, so that they are not excessively deformed.

I claim:

1. A drying apparatus with a base, which has a drying area, surrounded by a sealing surface, for receiving a substance to be dried, and with a cover, which can be placed in vacuum-tight manner on the marginal area of the sealing surface and the drying space formed between the drying area and the cover can be evacuated, wherein the sealing surface has a bearing area for the cover and the cover has a marginal area for resting on the sealing surface, the sealing surface is formed with at least one groove which can be evacuated when the cover rests on the sealing surface over the groove and wherein the sealing surface is provided with elastic seals for engaging the cover on opposite sides of the groove respectively.

2. A drying apparatus according to claim 1, wherein in its part covering the drying area, the cover is constructed as a stable hood.

3. A drying apparatus according to claim 1, wherein the cover is made entirely from rubber-elastic material.

4. A drying apparatus according to claim 1, wherein a porous support for the substance to be dried is placed in the drying area.

5. A drying apparatus according to claim 1, wherein a vacuum regulating means for the drying space is provided.

6. A drying apparatus according to claim 1, wherein there is a connecting channel between the groove and the drying area and the vacuum regulating device is located in the connecting channel.

7. A drying apparatus according to claim 1, wherein a vacuum measuring device is provided for determining and indicating the underpressure in the drying space.

8. A drying apparatus according to claim 1, wherein a temperature regulating element is connected to the drying space.

9. A drying apparatus according to claim 1, wherein the drying area in the apparatus base has a tray-like construction.

10. A drying apparatus according to claim 1, wherein the cover is made from transparent material.

11. A drying apparatus according to claim 1, wherein the drying area and the sealing surface are constructed as a one-piece metal plate.

12. A drying appararus according to claim 1, wherein the drying area is coated with a chemically resistant non-corrodible material.

* * * * *